US011213714B2

(12) United States Patent
Hansen et al.

(10) Patent No.: US 11,213,714 B2
(45) Date of Patent: Jan. 4, 2022

(54) WEIGHTLIFTING DEVICE

(71) Applicant: GUNGNIR AS, Oslo (NO)

(72) Inventors: Markus Leonhard Hansen, Kvaløya (NO); Andreas Gunnar Bossonney Gundersen, Oslo (NO); Audun Filip Sand, Oslo (NO)

(73) Assignee: GUNGNIR AS, Oslo (NO)

( * ) Notice: Subject to any disclaimer, the term of this patent is extended or adjusted under 35 U.S.C. 154(b) by 0 days.

(21) Appl. No.: 17/274,524

(22) PCT Filed: May 6, 2019

(86) PCT No.: PCT/EP2019/061481

§ 371 (c)(1),
(2) Date: Mar. 9, 2021

(87) PCT Pub. No.: WO2020/052815

PCT Pub. Date: Mar. 19, 2020

(65) Prior Publication Data

US 2021/0316181 A1 Oct. 14, 2021

(30) Foreign Application Priority Data

Sep. 11, 2018 (NO) ..... 20181186

(51) Int. Cl.
*A63B 21/072* (2006.01)

(52) U.S. Cl.
CPC ..... *A63B 21/0728* (2013.01); *A63B 21/0724* (2013.01); *A63B 21/0726* (2013.01)

(58) Field of Classification Search
CPC ..... A63B 21/0724; A63B 21/0726; A63B 21/0004; A63B 21/00058;
(Continued)

(56) References Cited

U.S. PATENT DOCUMENTS 4,738,446 A 4/1988 Miles
5,605,411 A 2/1997 Wilson
(Continued)

FOREIGN PATENT DOCUMENTS

DE 29720333 2/1998
SU 1664340 7/1991

OTHER PUBLICATIONS

International Search Report and Written Opinion mailed in PCT/EP2019/061481 dated Jul. 9, 2019 (7 pages).
(Continued)

*Primary Examiner* — Megan Anderson
(74) *Attorney, Agent, or Firm* — Wissing Miller LLP

(57) ABSTRACT

The invention relates to a weightlifting device comprising a longitudinally extending bar, the bar comprising at least one weight bearing section adapted for accommodating one or more free weights comprising an opening adapted for surrounding the weight bearings section. The weight bearing section comprises an end stop for the one or more free weights at a first end of the weight bearing section, a recess at or adjacent to a second opposite end of the weight bearing section and a free weight locking member for locking the free weights and for preventing the free weights from unintentionally falling off from the second end. The free weight locking member is movable in a longitudinal direction of the weight bearing section between the recess and at least one free weight locking position located between the recess and the end stop. The free weight locking member is further movable in a second direction at the recess between an immersed position and an elevated position, the immersed position being a position where the free weight locking member is completely, or at least mainly, immersed into the recess, and the elevated position being a position where the free weight locking member is elevated with
(Continued)

respect to the immersed position and extends at least partly outside the recess.

20 Claims, 6 Drawing Sheets

(58) Field of Classification Search
CPC ..... A63B 21/00061; A63B 21/00065; A63B 21/06; A63B 21/0601; A63B 21/0602; A63B 21/0603; A63B 21/0604; A63B 21/0605; A63B 21/0606; A63B 21/0607; A63B 21/0608; A63B 21/0609; A63B 21/0615; A63B 21/0616; A63B 21/0617; A63B 21/0618
See application file for complete search history.

(56) References Cited

U.S. PATENT DOCUMENTS

| | | | | |
|---|---|---|---|---|
| 6,875,161 | B1 * | 4/2005 | Brice | A63B 21/0724 482/107 |
| 7,087,000 | B1 | 8/2006 | Walker | |
| 7,811,213 | B2 | 10/2010 | Chen | |
| 8,827,878 | B1 | 9/2014 | Ciminski | |
| 9,005,088 | B2 * | 4/2015 | Sides, Jr. | A63B 21/4005 482/107 |
| 9,855,458 | B2 * | 1/2018 | Stilson | A63B 21/0728 |
| 2013/0090212 | A1 * | 4/2013 | Wang | A63B 71/0619 482/8 |
| 2017/0056704 | A1 | 3/2017 | Davies, III | |
| 2021/0016126 | A1 * | 1/2021 | Huang | A63B 21/0728 |

OTHER PUBLICATIONS

Norwegian Search Report mailed in NO20181186 dated Apr. 5, 2019 (2 pages).

* cited by examiner

WEIGHTLIFTING DEVICE

CROSS-REFERENCE TO RELATED APPLICATIONS

This application is a 371 of PCT/EP2019/061481 filed on May 6, 2019, published on Mar. 19, 2020 under publication number WO 2020/052815, which claims priority benefits from Norwegian Patent Application No. 20181186 filed Sep. 11, 2018, the disclosure of each is incorporated herein in their entirety by reference.

TECHNICAL FIELD

The invention relates to a weightlifting device, such as a barbell or a dumbbell.

BACKGROUND

A barbell weightlifting device normally consists of a bar and a plurality of discs of various weights with a central hole to permit the disc to slide onto the end of a bar where it is temporarily secured into place by collars in which the weights are secured in various ways, such as with a z-screw, torsion spring or by clamping.

Safety is of utmost concern in handling free weights—those weights not permanently affixed to a barbell or other weightlifting devices—because single weights may fall on a user and free weight systems are often used with great weightloading for body building and similar activities. Problems such as slippage of a securing collar can result in dangerous weight shifts. Accordingly, the free weights must be adequately secured to the barbell.

Many efforts have been made to improve the conventional barbell design, and specifically many different designs for locking free weights to the barbell have been proposed. For example, US 2017/0056704 A1 discloses a weight and locking mechanism for locking the weight to a barbell.

In addition, U.S. Pat. No. 4,738,446 discloses a securing mechanism for holding an exercise weight-disc on the end of the lifting bar while allowing a modicum of rotational movement in the disc as the bar is being manipulated by the exerciser. A sleeve-like collar-piece, having a smooth cylindrical bore which has therein a serrated flange, is fitted over the threaded end of a weight lifting bar that has a longitudinal groove passing through the set of threads. The collar-piece is slid onto the threaded end, and into registry with a weight-disc and thereafter rotated so that its rotatable gasket-surfaced face snubs against the weight-disc by virtue of the serrated flange engaging and working in cooperation with the bar threading. A ball-bearing/race, inserted in the collarpiece face, and to which the gasket is affixed, provides a rotatably movable base which will allow the weight-disc(s) to undergo a somewhat constrained rotation as the bar is twisted during lifting exercises.

Although many weightlifting devices with different types of attachment mechanisms have been proposed, there is still a strive towards providing an improved weightlifting device.

SUMMARY

In view of the above, an object of the present invention is to provide an improved weightlifting device having a safe, reliable and/or efficient locking mechanism for free weights, or at least an object is to provide a suitable alternative.

The object is achieved by a weightlifting device according to claim 1.

Thus, the invention relates to a weightlifting device comprising a longitudinally extending bar, the bar comprising at least one weight bearing section adapted for accommodating one or more free weights comprising an opening adapted for surrounding the weight bearing section. The weight bearing section comprises an end stop for the free weights at a first end of the weight bearing section. Further, the weight bearing section comprises a recess at or adjacent to a second opposite end of the weight bearing section, and a free weight locking member for locking the free weights and for preventing the free weights from unintentionally falling off from the second end. The free weight locking member is movable in a longitudinal direction of the weight bearing section between the recess and at least one free weight locking position located between the recess and the end stop. The free weight locking member is further movable in a second direction at the recess between an immersed position and an elevated position. The immersed position is a position where the free weight locking member is completely, or at least mainly, immersed into the recess, and the elevated position is a position where the free weight locking member is elevated with respect to the immersed position and extends at least partly outside the recess.

By the provision of the weightlifting device as disclosed herein, an improved locking mechanism is provided where free weights can be safely and/or reliably temporarily secured to the bar. More particularly, by the aforementioned configuration, where the free weight locking mechanism is movable between the immersed and the elevated position at the recess, it will be possible to allow the free weights to slide over the free weight locking member when it is in the immersed position. Thereby, a more efficient attachment and/or removal procedure for the free weights may be provided, where there is no need of removing the free weight locking member during the attachment/removal procedure.

Optionally, when the free weight locking member is in the immersed position, the free weight locking member may be prevented from moving in the longitudinal direction of the bar. This may allow the free weight locking member to be safely secured in situations when there are no free weights accommodated on the weight bearing section, such as during transport, before/after the weightlifting device is in use etc. The immersed position may also facilitate in avoiding damaging the free weight locking member when the weightlifting device is not used. Still optionally, when the free weight locking member is in the elevated position, the free weight locking member may be movable in the longitudinal direction.

Optionally, when the free weight locking member is in the immersed position, at least 90, 95, 96, 97, 98, or 99% of the free weight locking member's cross sectional area may be located in the recess, where the cross section is defined by a plane which is perpendicular to the longitudinal direction, even if it is preferred that 100% is immersed.

Optionally, the free weight locking member may be configured such that when it is in the immersed position, a perimeter profile of the free weight locking member facing outwardly from the weight bearing section substantially follows, or is smaller than, a perimeter profile of the weight bearing section. Thereby, free weights may more easily be slid over the recess when the free weight locking member is in the immersed position, since the free weight locking member not will extend outside the bar's perimeter profile.

Optionally, the free weight locking member and/or the weight bearing section may further comprise retention means for providing a retention force between the free weight locking member and the at least one free weight locking position. The retention means may be used for safely securing free weights to the weight bearing section.

Optionally, the retention means may comprise at least one male and/or female locking element on the free weight locking member and at least one mating female and/or male locking element at the at least one free weight locking position, thereby forming at least one mating pair of male/female locking elements for locking the free weight locking member to the a least one free weight locking position. A male/female locking configuration has been found to provide a reliable retention force during use of the weightlifting device. Especially, such a configuration is preferred when more heavy free weights are used. Still optionally, a direction for coupling and releasing the at least one mating pair of male/female locking elements may be substantially perpendicular with respect to the longitudinal direction, or inclined towards the end stop. In an example embodiment, the direction for coupling and releasing the at least one mating pair of male/female locking elements may be substantially radial with respect to the longitudinal direction, or inclined towards the end stop. The free weight locking member may thereby be able to accommodate larger loads from the free weight(s). In fact, this may allow a counterforce for preventing the free weight(s) from releasing to be mainly directed in the longitudinal direction of the bar. Further, if the direction is inclined towards the end stop, the counterforce may also be partially directed inwardly towards the center of the bar, which may further improve retention. Still further, and optionally, the direction for coupling/releasing may be substantially the same as the second direction.

Optionally, the retention means may comprise at least one of a magnet, a mechanical spring and a lever, z-screw, or similar, provided on the free weight locking member for providing a friction force between the free weight locking member and the weight bearing section. Such retention means may for example be used in combination with male/female retention means, thereby further improving the securement of the free weight locking member.

Optionally, the retention means may comprise a friction increasing coating provided on at least one of the free weight locking member and the weight bearing section. Such retention means may preferably be used in combination with other retention means, such as the retention means mentioned hereinabove. The coating may be provided on any one of the contacting surfaces between the free weight locking member and the weight bearing section.

Optionally, the weight bearing section may comprise a plurality of free weight locking positions in its longitudinal direction, preferably arranged in a row after each other in the longitudinal direction. Thereby, more than one free weight, and/or free weights with different widths may be secured to the weight bearing section.

Optionally, the free weight locking member may be movably secured to the weight bearing section. Hence, even though the free weight locking member is movable in the longitudinal direction and in the second direction at the recess, the free weight locking member may be secured such that it cannot be easily removed from the weight bearing section, thereby preventing the free weight locking member from falling off from the bar. It has namely been found that other releasable locking members, such as z-screws, can easily fall off from the bar and disappear during use. With the aforementioned configuration, the free weight locking member will be maintained on the bar and cannot easily be removed therefrom by e.g. a normal user.

Optionally, the free weight locking member may be movable in the longitudinal direction of the weight bearing section along at least one track provided on the weight bearing section. Still optionally, the at least one track may be at least one groove, preferably two grooves, more preferably two grooves at opposite sides, extending in the longitudinal direction of the weight bearing section.

Optionally, the weight bearing section may have a circular or elliptic cross sectional profile. Still optionally, the bar may have a circular or elliptic cross sectional profile.

Optionally, the weightlifting device may be any one of a barbell or a dumbbell, such as an Olympic standard barbell, a Powerlifting standard barbell, an Olympic dumbbell and a plate loaded strength training machine.

Optionally, at least the bar of the weightlifting device may be made of metal or a metal alloy, such as steel and/or titanium alloy. Still optionally, also the free weight locking member may be made of metal or a metal alloy, such as steel and/or titanium alloy.

Optionally, the weightlifting device may further comprise at least one free weight provided on the free weight bearing section.

Optionally, the free weight locking member may have a partially circular or partially elliptic cross sectional profile.

Optionally, the weightlifting device may comprise two free weight bearing sections adapted for receiving free weights from a respective first and second end of the bar. The second free weight bearing section may be configured according to any one of the aforementioned embodiments.

Optionally, the end stop at the first end of the weight bearing section may be movably arranged on the bar. For example, the end stop may be similarly configured as the free weight locking member and the recess provided at, or adjacent to, the second end. Thereby, improved flexibility may be provided where the one or more free weights can be placed in more locations along the bar.

BRIEF DESCRIPTION OF THE DRAWINGS

With reference to the appended drawings, below follows a more detailed description of embodiments of the invention cited as examples.

In the drawings.

Figure 1:
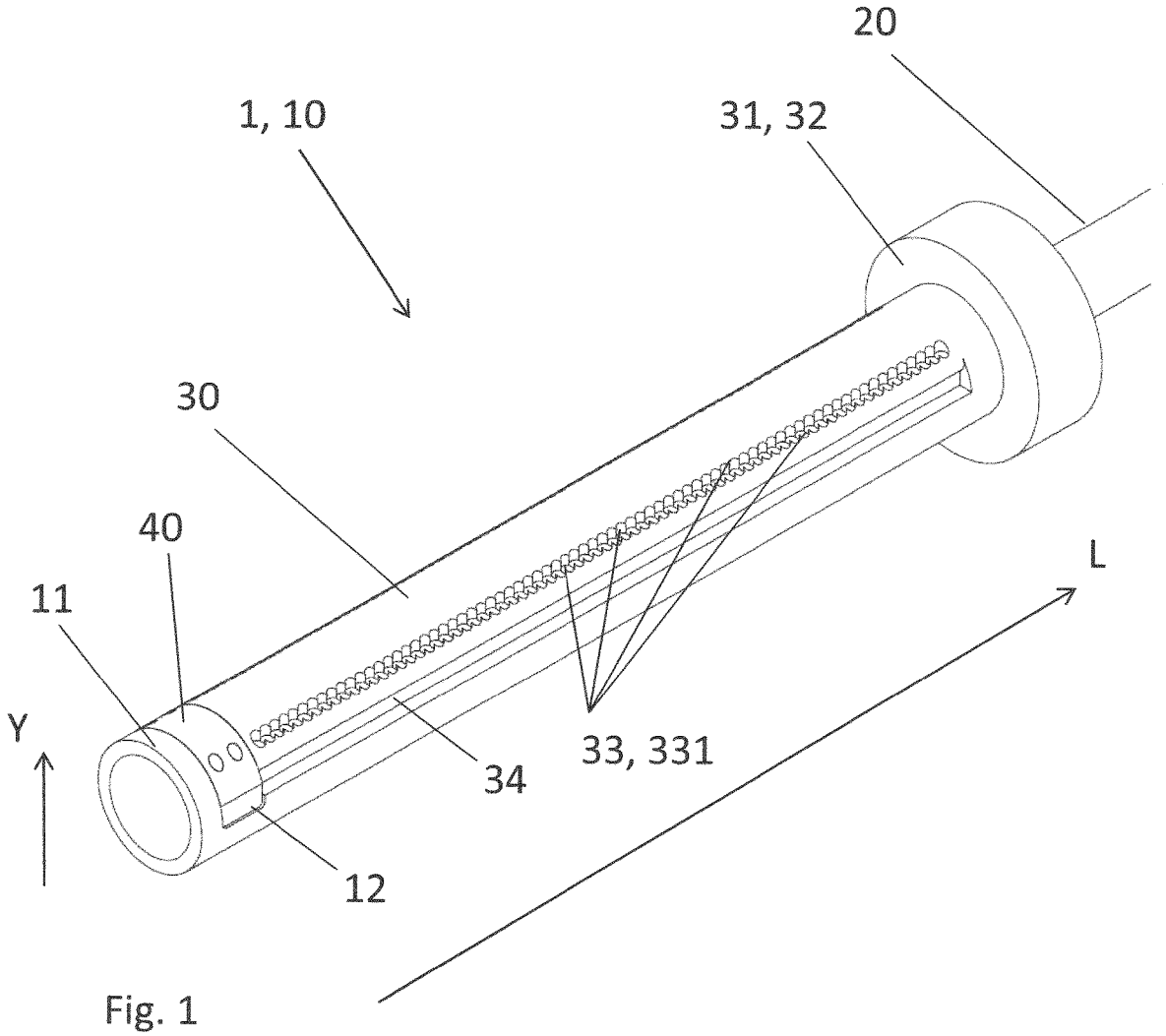
FIG. 1 depicts a three-dimensional view of a weightlifting device according to an example embodiment of the present invention.

The drawings show diagrammatic exemplifying embodiments of the present invention and are thus not necessarily drawn to scale. It shall be understood that the embodiments shown and described are exemplifying and that the invention is not limited to these embodiments. It shall also be noted that some details in the drawings may be exaggerated in order to better describe and illustrate the invention. Like reference characters refer to like elements throughout the description, unless expressed otherwise.

DETAILED DESCRIPTION OF EXAMPLE EMBODIMENTS OF THE INVENTION

With reference to FIGS. 1, 2 and 3*a*-*b*, a weightlifting device 1 according to an example embodiment of the present invention is shown. The weightlifting device 1 comprises a longitudinally extending bar 10, and the bar 10 comprises a weight bearing section 30 adapted for accommodating free weights 100 comprising an opening 101, which here is a central opening. The bar 10 further comprises a gripping section 20 where a user can hold the weightlifting device 1. The weight bearing section 30 comprises an end stop 31 for the free weights 100 at a first end 32 of the weight bearing section 30, a recess 12 at or adjacent to a second opposite end 11 of the weight bearing section 30 and a free weight locking member 40 for locking the free weights 100 and for preventing the free weights 100 from unintentionally falling off from the second end 11. The second end 11 is in this embodiment an outer end of the bar 10 and the end stop 31 is here configured as a collar on the bar 10 which separates the weight bearing section 30 and the gripping section 20. Alternatively, the collar 31 may be replaced, and/or complemented, with a free weight locking member and a recess with similar configuration as the recess 12 and the member 40, thereby providing an improved flexibility of mounting free weights on the bar 10.

Further, the free weight locking member 40 is movable in a longitudinal direction L of the weight bearing section 30 between the recess 12 and at least one free weight locking position 33 located between the recess 12 and the end stop 31. Here, the weight bearing section 30 comprises a plurality of free weight locking positions 33 arranged in a row along the longitudinal extension of the weight bearing section 30. Thereby, the number of free weights 100 provided on the bar 10 can be varied, resulting in a more flexible weightlifting device.

The free weight locking member 40 is further movable in a second direction Y at the recess 12 between an immersed position and an elevated position with respect to the recess 12. The second direction Y is different from the longitudinal direction L, and is here a radial direction Y of the bar 10. The immersed position is a position where the free weight locking member 40 is completely, or at least mainly, immersed into the recess 12, and the elevated position is a position where the free weight locking member 40 is elevated with respect to the immersed position and extends at least partly outside the recess 12. FIG. 1 shows the situation when the free weight locking member 40 is in the immersed position. In this particular embodiment, a perimeter profile of the free weight locking member 40 which faces outwardly from the weight bearing section 30 substantially follows a perimeter profile of the weight bearing section 30. Thereby, as can be seen, when the free weight locking member 40 is in the immersed position, the weight bearing section 30 will in this example embodiment have substantially the same diameter along the whole extension of the weight bearing section 30 where the free weights 100 are meant to be received. As a consequence, free weights 100 can be slid over the free weight locking member 40 towards the collar 31.

The second direction Y is in this embodiment substantially perpendicular to the longitudinal direction L, i.e. it extends radially with respect to the bar 10, which is one preferred embodiment. Thereby, a movement of the free weight locking member 40 from the immersed position to the elevated position will result in an increased cross sectional area of the weight bearing section 30 at the recess 12. However, the second direction can also be directed differently, as long as the movement from the immersed position to the elevated position will result in an increased cross sectional area of the weight bearing section 30 at the recess 12, where the cross sectional area is defined by a plane which is perpendicular to the longitudinal extension L.

Figure 2:
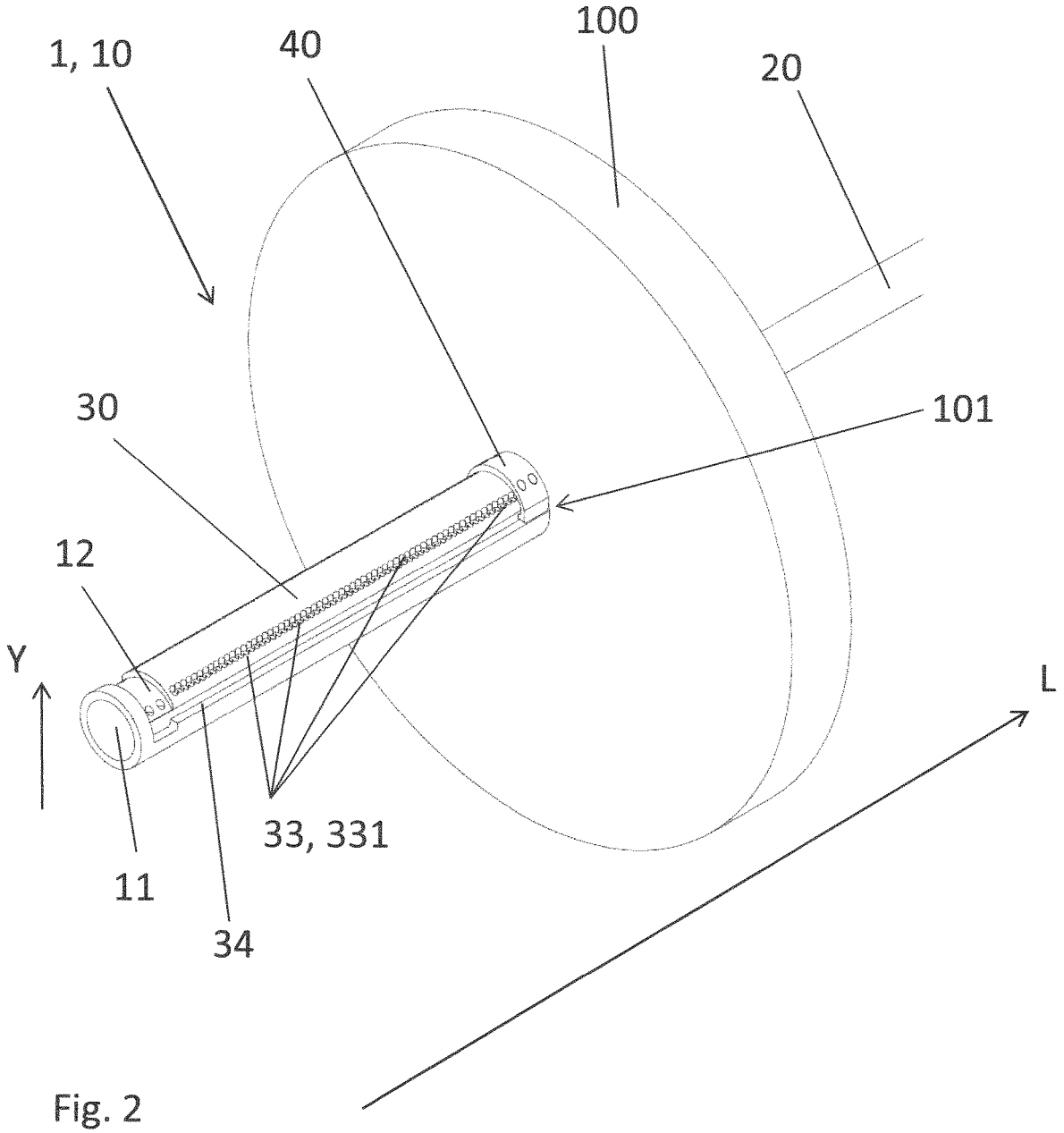
FIG. 2 depicts a three-dimensional view of the weightlifting device as shown in FIG. 1 when a free weight has been attached thereto.

FIG. 2 shows when a free weight 100 has been provided onto the weight bearing section 30 and where the free weight 100 has been locked between the free weight locking member 40 and the collar 31, which is hidden from view in FIG. 2. The free weight 100 has been provided onto the weight bearing section 30 from the second end 11 when the free weight locking member 40 was in its immersed position in the recess 12. Thereafter, the free weight locking member 40 has been elevated to its elevated position and then moved in the longitudinal direction L towards the collar 31 and the free weight 100. Finally, the free weight locking member 40 has been locked at a free weight locking position 33 which is most proximate the free weight 100, and thereby the free weight 100 has been locked to the weightlifting device 1 and is thereby also prevented from unintentionally falling off from the second end 11.

When the free weight locking member 40 is in the elevated position it can be moved in the longitudinal direction L along a track 34. The track 34 is in this embodiment provided as two grooves located on opposite sides of the weight bearing section 30 (only one of the grooves can be seen). The grooves 34 are angularly offset in the circumference of the weight bearing section 30. As can be seen in FIGS. 1-3, the weight bearing section 30 has a circular cross section, even though also other cross sectional shapes can be used, such as elliptical cross sections.

Further, in this embodiment, the free weight locking member 40 comprises male locking elements 41 and the weight bearing section 30 at the free weight locking positions 33 comprises mating female locking elements 331, thereby forming mating pairs of male/female locking elements. This configuration can be more clearly seen in FIGS. 3*a*-3*b* where the free weight locking member 40 is separated from the weight bearing section 30.

Figure 3A:
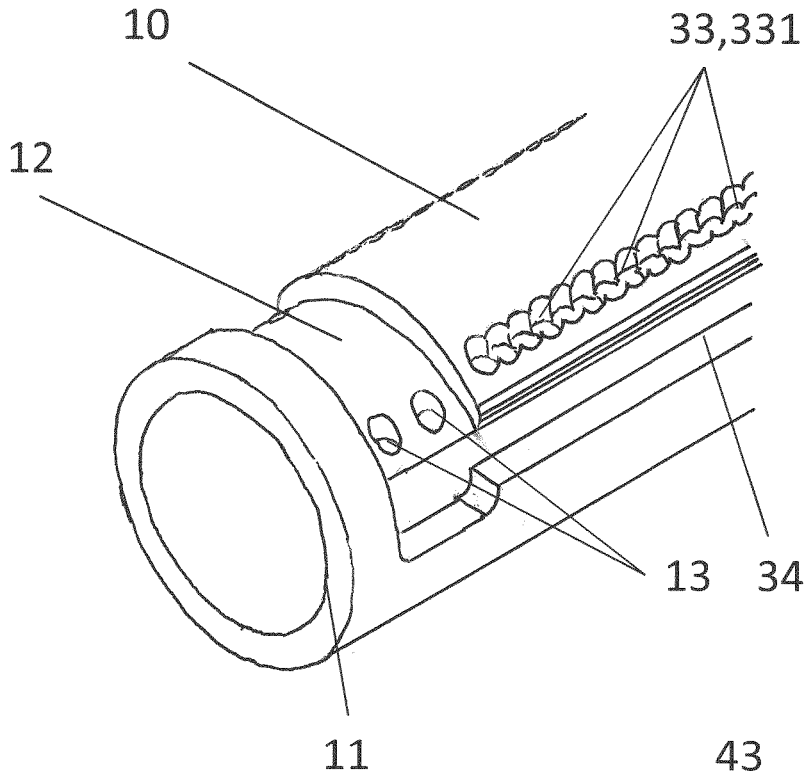
FIGS. 3*a* and 3*b* depict a more detailed view of the different parts of the weightlifting device as shown in FIG. 1.
Figure 3B:
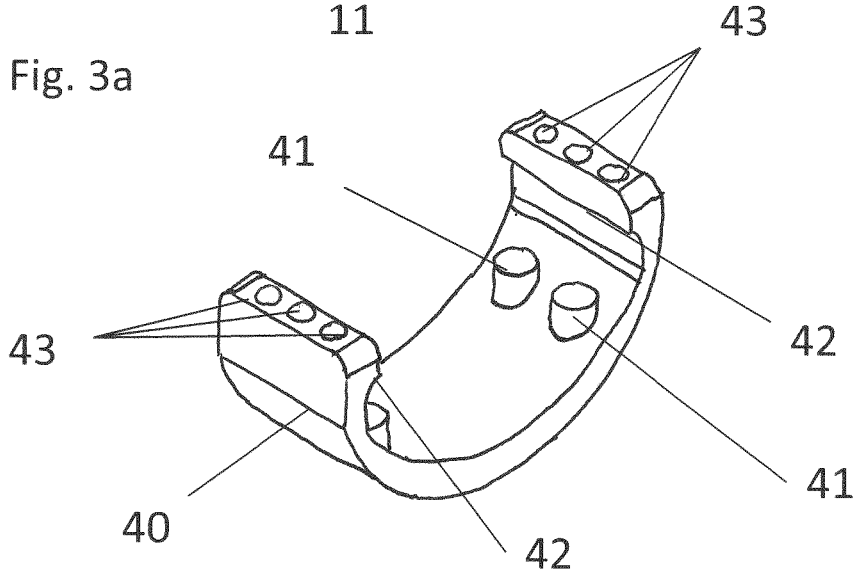

With reference to especially FIG. 3*a*, it can be seen that the weight bearing section 30 comprises a plurality of female locking elements 331 which are provided as indentations arranged in a row along the longitudinal direction L. Also, the recess 12 is provided with similarly shaped indentations 13. The indentations 13 and 331 are configured such that they can receive mating male locking elements 41 provided on the free weight locking member 40, see FIG. 3*b*. The free weight locking member 40 is also provided with running members 42 which are arranged to slide along the track 34. Hence, in this particular embodiment, the running members 42 are arranged to slide along the two angularly offset grooves 34. Further, the running members 42 are protruding radially inwardly with respect to the bar 10, and therefore movably secures the free weight locking member 40 to the weight bearing section 30 of the bar 10. The free weight locking member 40 is locked to the free weight locking position 33 by moving the free weight locking member 40 radially inwardly towards the center of the bar 10 such that the male locking elements 41 mate with the female locking elements 331.

Further, the free weight locking member 40 is having a partially circular cross sectional profile, which in this embodiment is a semi-circular profile with an extension of about 180 degrees. Still further, the free weight locking member 40 comprises additional optional retention means 43, which here are magnets provided on the outer circumferential ends of the free weight locking member 40. The magnets 43 are arranged to generate a magnetic force between the weight bearing section 30 and the free weight locking member 40. For example, the magnetic force may be used for more easily attracting the free weight locking member 40 into the immersed position when it is located at the recess 12. The magnetic force may also advantageously be used at the free weight locking positions 33 for more easily attracting the free weight locking member 40 into its locking positions. The weight bearing section 30 may also comprise magnets, for example located in the recess 12 and/or in or close to the track 34. The bar 10 may also be made of a material which in itself is magnetic, such as magnetic steel.

Figure 4:
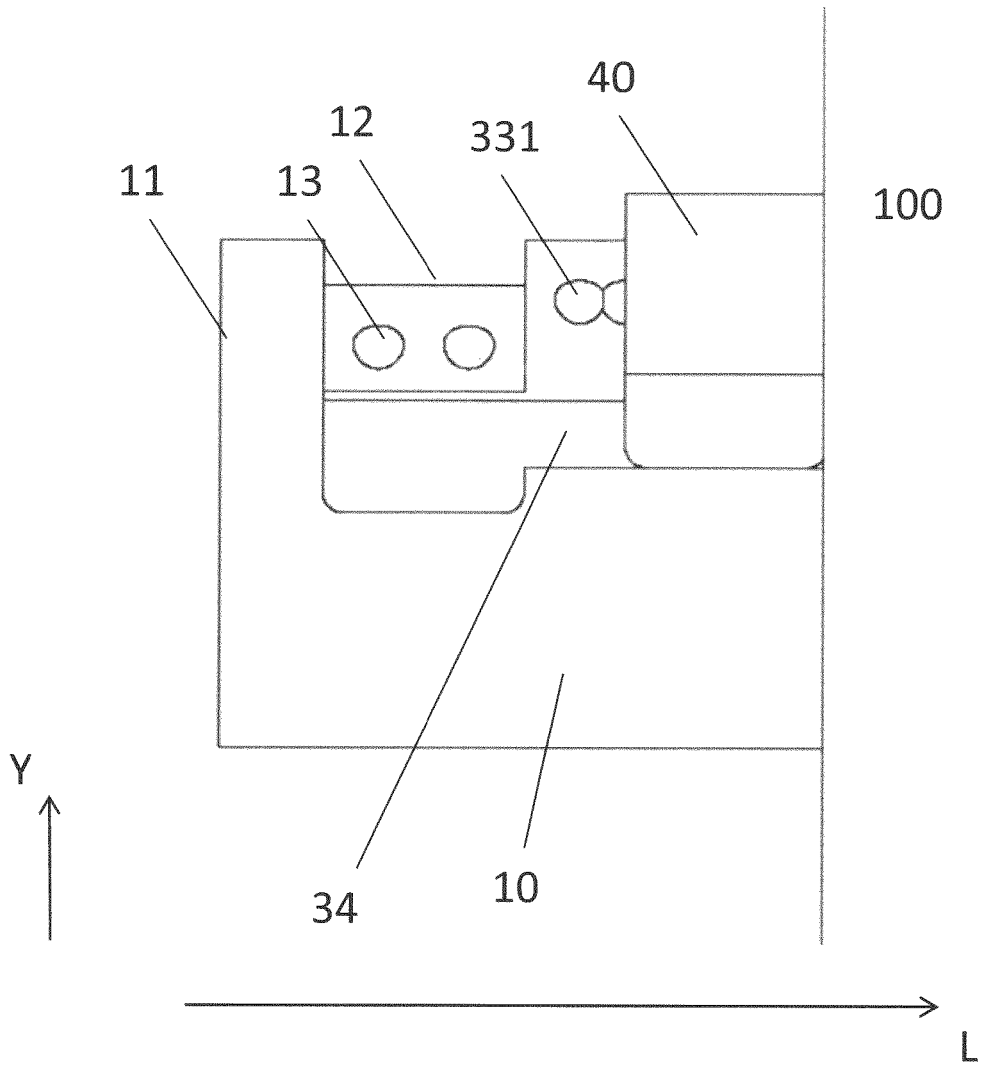
FIG. 4 depicts a longitudinal cross-sectional view of a weightlifting as shown in FIGS. 1-3*b;*

FIG. 4 shows a detail of a longitudinal cross section of a weightlifting device 1 as shown in FIGS. 1-3*b*. The free weight locking member 40 is here locking at least one free weight 100 to the bar 10. The male locking elements 41 of the free weight locking member 40, which are not seen here, are provided into the mating female locking elements 331, thereby locking the member 40 to the locking position 33.

Figure 5:
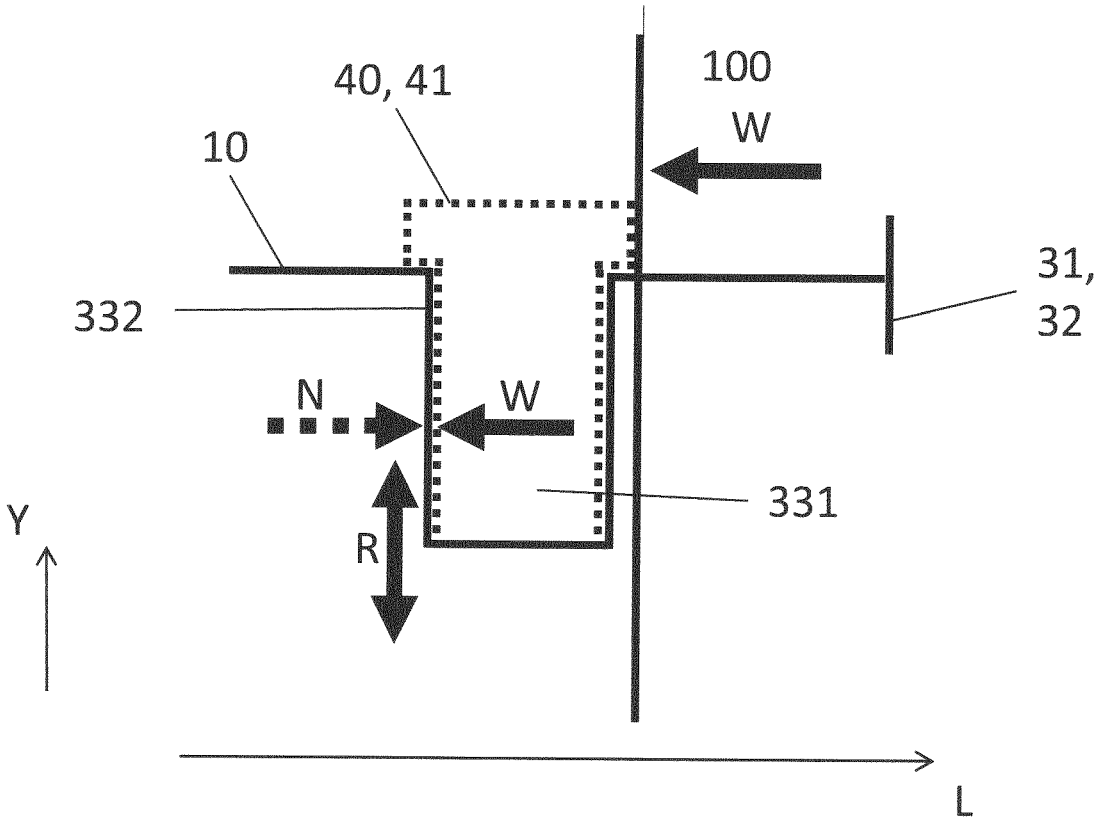
FIG. 5 depicts a schematic illustration of a weightlifting device with retention means according to an example embodiment of the present invention.
Figure 6:
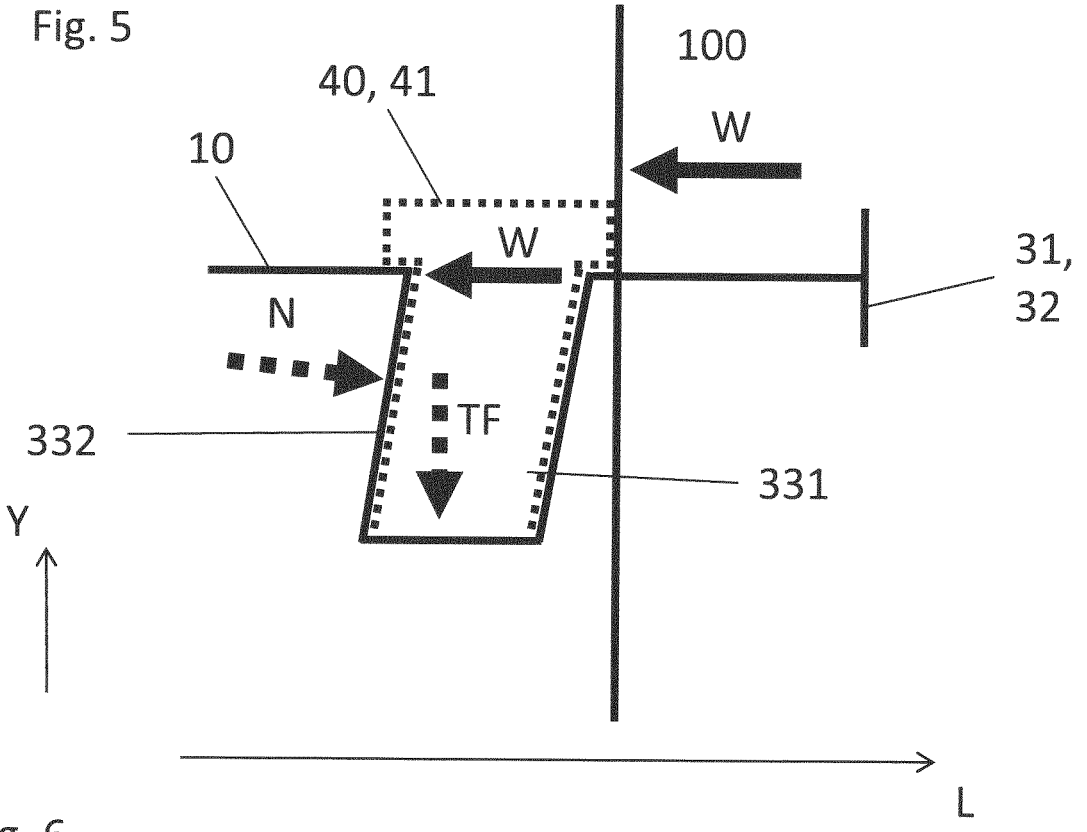
FIG. 6 depicts a schematic illustration of another weightlifting device with retention means according to an example embodiment of the present invention.

With reference to FIGS. 5 and 6, schematic illustrations of two different retention means configurations are shown. The retention means are here mating pairs of male/female locking elements, 41 and 331 respectively. In FIG. 5, the male/female locking elements are configured such that a direction for coupling and releasing the mating pair of male/female locking elements, 41 and 331, is substantially perpendicular with respect to the longitudinal direction L. Thereby, when a load W from a free weight 100 is exerted onto the free weight locking member 40, a normal force N will prevent the free weight from releasing from its locked position. The normal force N will be directed in the longitudinal direction L of the bar 10 since the inner wall 332 of the female locking element 331, which here is provided as an indentation, is oriented perpendicularly to the longitudinal direction L. The inner wall 332 also has a specific friction coefficient, which may be increased by e.g. providing a friction increasing coating thereon. A friction force R will thereby also prevent the male locking element 41 from releasing from the indentation 331, the friction force R being equal to the friction coefficient times the normal force N.

In FIG. 6, the male/female locking elements are configured such that a direction for coupling and releasing the mating pair of male/female locking elements, 41 and 331, is inclined towards the end stop 31. The retention means are also here mating pairs of male/female locking elements, 41 and 331 respectively. Thereby, when a load W from a free weight 100 is exerted onto the free weight locking member 40, a normal force N will prevent the free weight 10 from releasing from its locked position. The normal force N will be directed in the longitudinal direction L of the bar 10 and also inwardly towards the center of the bar 10, since the inner wall 332 of the female locking element 331 is inclined towards the end stop 31. Thereby, an even further improved retention may be provided since also a retention force TF directed inwardly may prevent the free weight locking member 40 from releasing when the load W is exerted onto the free weight locking member 40.

Figure 7A:
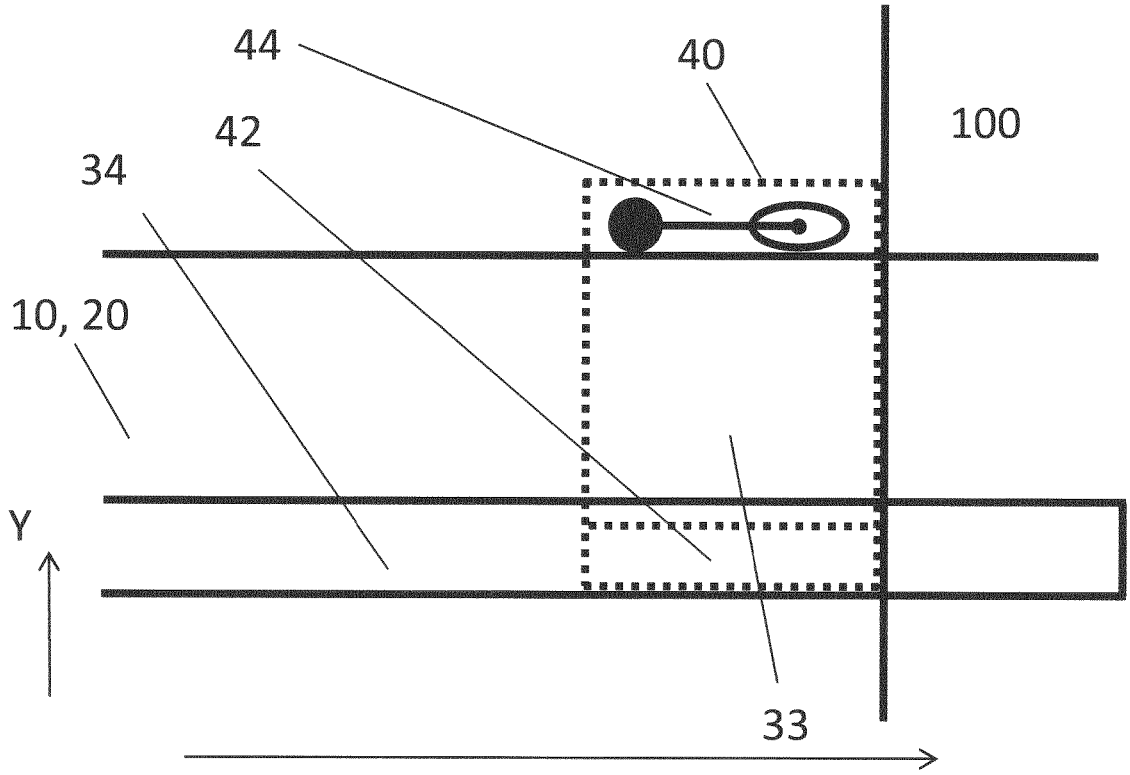
FIGS. 7*a* and 7*b* depict a schematic illustration of yet another weightlifting device with retention means according to an example embodiment of the present invention.
Figure 7B:
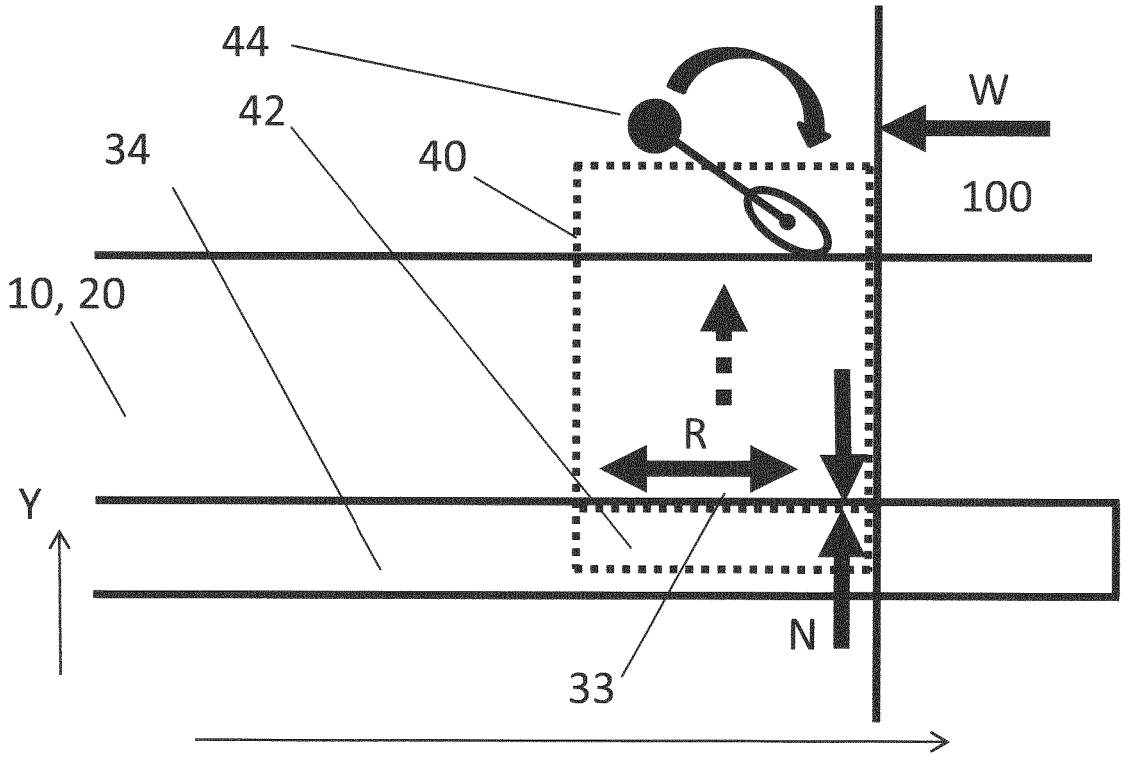

With reference to FIGS. 7*a* and 7*b*, a schematic illustration of another retention means is shown, which may be used as a complement or as an alternative to e.g. the aforementioned male/female locking elements. Here, the free weight locking member 40 is provided with a lever member 44 arranged to lock the free weight locking member 40 to the free weight locking position 33. When rotating the lever member 44, the free weight locking member 40 will move in the Y direction to thereby clamp the free weight locking member 40 to the weight bearing section 30. In this example embodiment, when rotating the lever 44, the running member 42 is moved upwardly towards an upper surface of the groove 34, resulting in a clamping force N, which is shown in FIG. 7*b*. A load W exerted onto the free weight locking member 40 from a free weight 100 will result in a retention force R which is equal to the friction coefficient between the clamped surfaces and the normal force N. In a similar manner, the retention force R may also be generated by the use of e.g. a mechanical spring, or the like. Still further, a friction increasing coating may further increase the retention force R.

It is to be understood that the present invention is not limited to the embodiments described above and illustrated in the drawings; rather, the skilled person will recognize that many changes and modifications may be made within the scope of the appended claims. For example, the free weight locking member 40 as described with reference to e.g. FIG. 1 is shaped as half of a circle. However, also other shapes are possible, such as smaller circle sections and also larger circle sections.

The invention claimed is:

1. A weightlifting device comprising a longitudinally extending bar, the longitudinally extending bar comprising:

at least one weight bearing section adapted for accommodating one or more free weights comprising an opening adapted for surrounding the at least one weight bearing section, the at least one weight bearing section comprising:

an end stop for the one or more free weights at a first end of the at least one weight bearing section;

a recess at or adjacent to a second opposite end of the at least one weight bearing section;

a free weight locking member for locking the one or more free weights and for preventing the one or more free weights from unintentionally falling off from the second opposite end, the free weight locking member being movable in a longitudinal direction of the at least one weight bearing section between the recess and at least one free weight locking position located between the recess and the end stop, the free weight locking member is further movable in a second direction at the recess between an immersed position and an elevated position with respect to the recess, the immersed position being a position where the free weight locking member is immersed into the recess, and the elevated position being a position where the free weight locking member is elevated with respect to the immersed position and extends at least partly outside the recess.

2. The weightlifting device according to claim 1, further comprising at least one locking element on the free weight locking member and at least one mating locking element at the at least one free weight locking position, forming at least one mating pair of locking elements for locking the free weight locking member to the at least one free weight locking position.

3. The weightlifting device according to claim 2, wherein a direction for coupling and releasing the at least one mating pair of locking elements is perpendicular with respect to the longitudinal direction, or inclined towards the end stop.

4. The weightlifting device according to claim 1, wherein the free weight locking member is movable in the longitudinal direction of the at least one weight bearing section along at least one track provided on the at least one weight bearing section.

5. The weightlifting device according to claim 4, wherein the at least one track includes at least one groove extending in the longitudinal direction of the at least one weight bearing section.

6. The weightlifting device according to claim 1, wherein when the free weight locking member is in the immersed position, the free weight locking member is prevented from moving in the longitudinal direction of the longitudinally extending bar.

7. The weightlifting device according to claim 1, wherein when the free weight locking member is in the elevated position, the free weight locking member is movable in the longitudinal direction.

8. The weightlifting device according to claim 1, wherein the free weight locking member is configured such that when it is in the immersed position, a perimeter profile of the free weight locking member facing outwardly from the at least one weight bearing section is the same size as or is smaller than a perimeter profile of the at least one weight bearing section.

9. The weightlifting device according to claim 1, wherein the free weight locking member and the at least one weight bearing section further comprises retention means for providing a retention force between the free weight locking member and the at least one free weight locking position, or wherein the free weight locking member or the at least one weight bearing section further comprises retention means for providing a retention force between the free weight locking member and the at least one free weight locking position.

10. The weightlifting device according to claim 1, further comprising at least one of a magnet, a mechanical spring and a lever, and a z-screw provided on the free weight locking member for providing a friction force between the free weight locking member and the at least one weight bearing section.

11. The weightlifting device according to claim 1, further comprising a friction increasing coating provided on at least one of the free weight locking member and the at least one weight bearing section.

12. The weightlifting device according to claim 1, wherein the at least one weight bearing section comprises a plurality of free weight locking positions in its longitudinal direction arranged in a row after each other in the longitudinal direction.

13. The weightlifting device according to claim 1, wherein the free weight locking member is movably secured to the at least one weight bearing section.

14. The weightlifting device according to claim 1, wherein the at least one weight bearing section has a circular or elliptic cross sectional profile.

15. The weightlifting device according to claim 1, wherein the weightlifting device comprises one of a barbell, a dumbbell, and a plate loaded strength training machine.

16. A weightlifting bar adapted to receive one or more free weights, the weightlifting bar comprising:

a plurality of weight bearing sections, each of the plurality of weight bearing sections including:

a first end and a second end;

an end stop at the first end of the weight bearing section;

a recess at or adjacent the second end of the weight bearing section; and at least one locking position located on the weight bearing section between the recess and the end stop; and a locking member having an outer perimeter profile and at least one locking element extending from an inner surface of the locking member, the locking member being movable in the recess between an immersed position and an elevated position, and when the locking member is in the elevated position the locking member is movable along the weight bearing section between the recess and the at least one locking position.

17. The weightlifting bar according to claim 16, wherein when the locking member is moved to the at least one locking position the at least one locking element engages the at least one locking position.

18. A weightlifting bar adapted to receive one or more free weights, the weightlifting bar comprising:

at least one weight bearing section including:

a first end, a second end spaced from the first end and an outer profile;

an end stop at the first end of the at least one weight bearing section;

a recess at or adjacent the second end of the at least one weight bearing section; and at least one locking position located between the recess and the end stop; and a locking member having an outer perimeter profile and at least one locking element extending from an inner surface of the locking member, the locking member being movable in the recess between an immersed position and an elevated position:

wherein when the locking member is in the immersed position the outer perimeter profile of the locking member aligns with the outer perimeter profile of the at least one weigh bearing section, and when the locking member is in the elevated position the outer perimeter profile of the locking member extends at least partially outside the outer perimeter profile of the at least one weigh bearing section; and wherein when the locking member is in the elevated position, the locking member is movable along the at least one weight bearing section between the recess and the at least one locking position.

19. The weightlifting bar according to claim 18, wherein when the locking member is moved to the at least one locking position the at least one locking element engages the at least one locking position.

20. The weightlifting bar according to claim 18, wherein the at least one locking position comprises a plurality of locking positions.

* * * * *